United States Patent [19]

Blackburn

[11] 3,957,392

[45] May 18, 1976

[54] SELF-ALIGNING VANES FOR A TURBOMACHINE

[75] Inventor: Ronald Blaine Blackburn, Peoria, Ill.

[73] Assignee: Caterpillar Tractor Co., Peoria, Ill.

[22] Filed: Nov. 1, 1974

[21] Appl. No.: 519,985

[52] U.S. Cl. ..... 415/146; 415/161

[51] Int. Cl.[2] ..... F04D 27/02; F04D 25/10

[58] Field of Search ..... 415/146, 181, 148, 162, 415/161; 416/136, 137, 138

[56] References Cited

UNITED STATES PATENTS

| | | | |
|---|---|---|---|
| 1,136,877 | 4/1915 | Homersham | 415/146 |
| 1,771,711 | 7/1930 | Hahn | 415/146 |
| 2,566,550 | 9/1951 | Birmann | 415/161 |
| 3,162,421 | 12/1964 | Schwarz | 415/161 |
| 3,356,289 | 12/1967 | Plotkowiak | 415/161 |
| 3,588,270 | 6/1971 | Boeles | 415/162 |
| 3,756,739 | 9/1973 | Boussuges | 415/161 |

FOREIGN PATENTS OR APPLICATIONS

| | | | |
|---|---|---|---|
| 582,813 | 10/1924 | France | 416/136 |
| 547,491 | 4/1932 | Germany | 415/161 |
| 757,714 | 2/1953 | Germany | 416/136 |
| 302,953 | 12/1928 | United Kingdom | 415/141 |
| 762,254 | 11/1956 | United Kingdom | 415/181 |

*Primary Examiner*—Henry F. Raduazo
*Attorney, Agent, or Firm*—Wegner, Stellman, McCord, Wiles & Wood

[57] ABSTRACT

The outlet of a centrifugal compressor is provided with an annular row of movable diffuser vanes which align with the fluid flow direction to prevent a surge condition. Each movable diffuser vane has a pivot axis forward of the vane's center of pressure to cause the fluid from the impeller to move the vane such that the flow meets the diffuser vane leading edge with a near-zero incident angle. The vanes are floating or freely movable on the pivot axis except for spring bias which prevents flutter. In some embodiments, the movable vanes are upstream of primary fixed diffuser vanes, of the vane-island or of the airfoil vane type, and are movable between a closed position abutting the primary vanes to variable open positions which create auxiliary diffuser channels.

5 Claims, 23 Drawing Figures

45
42
43
40
27
27
34
30
36
37
35
28
24
39
26
38
44
22
20

TO 45
46
42
50
47
48
56
22
52
53
50
47
54
60
50
52
58
56
47
62
48

112
47
48
46
114
110
62
112
47
54
52
50
60
46
47
84
82
R
80
48
DESIGN POINT
INCIPIENT SURGE
PRESSURE RATIO
118
116
MASS FLOW

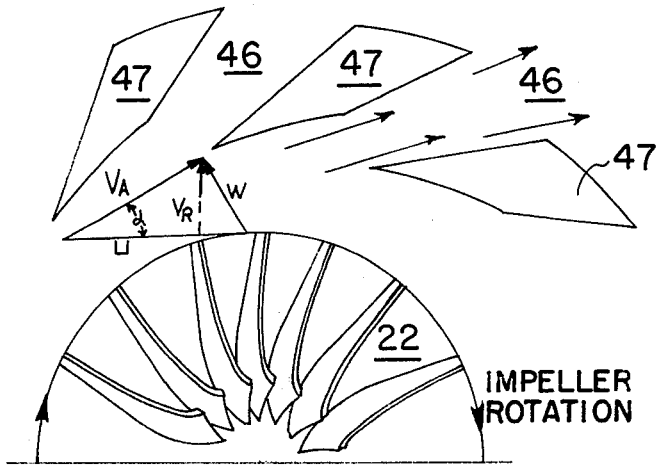
DIFFUSER INLET VELOCITY "TRIANGLE" SCHEMATIC
$V_A$ = ABSOLUTE VELOCITY
$V_R$ = RADIAL VELOCITY COMPONENT
W = RELATIVE VELOCITY (TO IMPELLER)
U = IMPELLER TIP SPEED
α = ANGLE BETWEEN $V_A$ & U ; U IS NORMAL TO AN IMPELLER ℄
Fig. 13
Fig. 13A
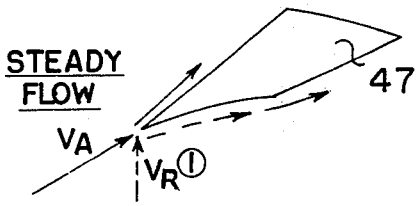
Fig. 13A-D
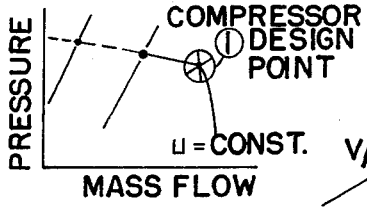
Fig. 13 D
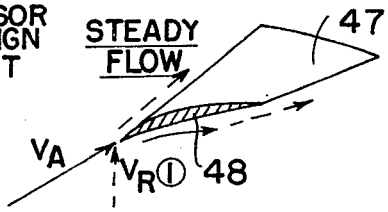
Fig. 13B
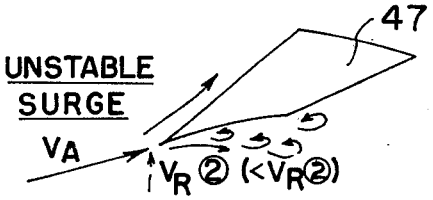
Fig. 13B-E
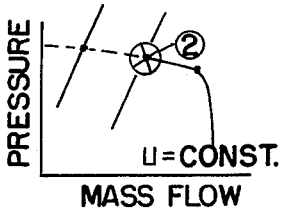
Fig. 13E
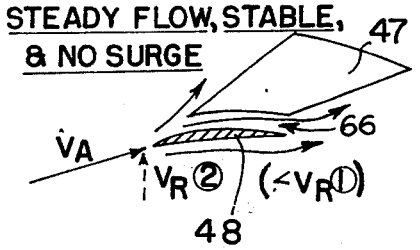
Fig. 13C
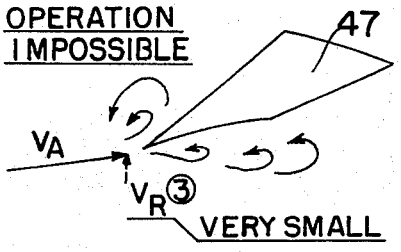
Fig. 13C-F
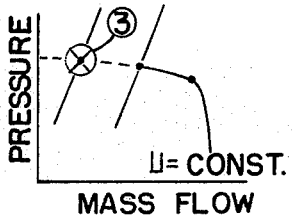
Fig. 13F
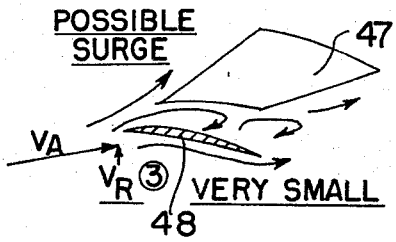

SELF-ALIGNING VANES FOR A TURBOMACHINE

BACKGROUND OF THE INVENTION

This invention relates to turbomachines which include self-aligning vanes.

The efficiency and stability of a compressor is dependent upon the means for converting the kinetic energy of the air leaving the impeller into static pressure. Most high-performance centrifugal stages used a fixed-vane diffusion section to accomplish this kinetic energy conversion. The low flow limit for the compressor corresponds to the onset of a surge or stall condition which occurs as the fluid flow from the impeller becomes more tangential as the fluid flow decreases. This produces a large flow angle and magnitude with respect to the leading edge of the fixed diffuser vanes, creating a violent instability in the stage. The high flow or max-flow limit corresponds to a choke condition caused as increasing fluid flow from the impeller becomes more radial and finally chokes the diffuser throat with very large kinetic energy loss. The design point is generally established such that the fluid flow meets the diffuser vane leading edge with zero or small incident angle.

Various techniques are used to increase the range between the surge and choke limits, especially when the compressor is utilized in a high performance gas turbine engine or turbocharger. One technique to increase the compressor's range is to utilize power actuated movable vanes which are driven by an external motive system, either between closed and open positions, or infinitely, as disclosed for example in ASME paper 68-GT-63, entitled "Variable Geometry Gas Turbine Radial Compressors", by C. Rogers. Another example is disclosed in U.S. Pat. No. 3,588,270 to Albin Boelcs in which a centrifugal compressor has a diffuser with two coaxially arranged rows of rotatable guide vanes in which the pivot axis of the vanes are displacable in relation to one another by externally driven annular vane disks. The driven movable vanes, and other apparatus for defeating a surge condition, have been controlled by various control systems having an input transducer for sensing the onset of a surge condition. In U.S. Pat. No. 2,566,550 to R. Birmann, a freely rotatable flag or vane is located upstream of the entrance edges of one pair of fixed diffuser vanes to indicate the onset of a surge condition as the flag moves to a more tangential position, actuating a motive mechanism for preventing the surge condition.

All such prior techniques are complex and require the accommodation of power actuating motive means and surge sensors as well as a control system. Furthermore, such techniques are not readily adaptable to solve the problem of changing fluid direction in other stages of a gas turbine engine such as the second stage nozzle of a two-stage turbine.

SUMMARY OF THE INVENTION

In accordance with the present invention, the problems with prior surge preventing means for turbomachinery have been overcome. The diffuser section of a compressor includes a row of freely movable or floating diffuser vanes each of which has a pivot axis forward of the center of pressure of the vane for causing the fluid flow itself to directly move the vane into alignment with the flow direction. Spring biasing may be included to damp any flutter in the movable vanes. In most embodimets, a row of primary fixed diffuser vanes are located immediately downstream of the row of movable vanes, and the movable vanes can be rotated against the fixed vanes to in effect form a single row of diffuser vanes. The disclosed self-aligning vane techniques are adaptable to both vane-island diffusers and airfoil-vaned diffusers. In addition, the disclosed techniques for creating near-zero incident flow into a vane leading edge can be used in other stages of a gas turbine engine, such as in the second stage nozzle of a two-stage turbine.

One object of the present invention is the provision of turbomachinery having a row of self-aligning vanes which are movable directly by the fluid flow stream to create near-zero incident flow into the vane leading edge.

Other changes and advantages of the present invention will be apparent from the following description and from the drawings. While illustrative embodiments of the invention are shown in the drawings and will be described in detail herein, the invention is susceptible of embodiment in many different forms and it should be understood that the present disclosure is to be considered as an exemplification of the principles of the invention and is not intended to limit the invention to the embodiments illustrated.

BRIEF DESCRIPTION OF THE DRAWINGS

FIG. 13 is a schematic representation of the components of airflow in a diffuser inlet;

FIGS. 13A through 13F are schematic representations showing a comparison between a fixed vane diffuser and a floating vane diffuser with the airflow being figuratively illustrated to show the surge improvement or negation; and FIGS. 13A–D, 13B–E, and 13C–F are performance maps for the diffusers shown in FIGS. 13A and 13D, FIGS. 13B and 13E, and FIGS. 13C and 13F, respectively.

CENTRIFUGAL COMPRESSOR WITH MOVING VANE - VANE ISLAND DIFFUSER

Figure 1:
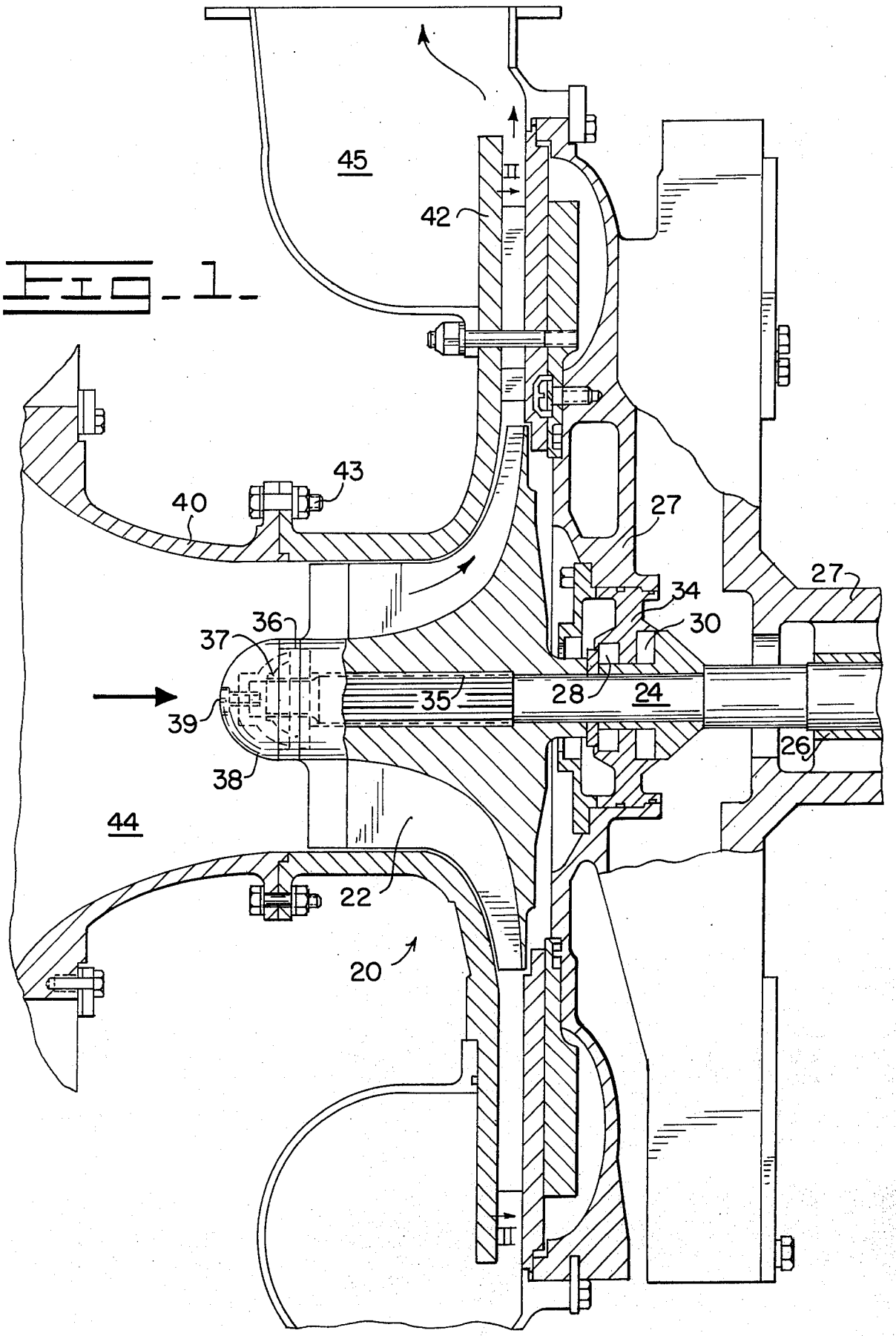
FIG. 1 is a partial side section showing a centrifugal compressor and diffuser stage which form a part of a gas turbine engine.

Turning to FIG. 1, the illustrated centrifugal compressor assembly group 20 may form a part of a gas turbine engine or turbocharger. The assembly group 20 includes an impeller or compressor wheel 22 which is driven at variable speeds by a turbine wheel or other means (not illustrated) through a drive shaft 24. The drive shaft 24 is supported on the right by a bearing 26 in a housing 27, and on the left by bearings 28 and 30 supported by an adapter 34 located in a bore of the housing 27. The impeller wheel 22 is connected to the drive shaft 24 by spline means 35 and is retained by a spacer 36 and a lock nut 37. The end of the shaft 24 carries a round-nosed cap 38 retained by a capscrew 39.

Compressor group 20 further includes a bellmouth air inlet housing 40 connected to a diffuser assembly 42 by a plurality of bolts 43. Fluid such as ambient air is drawn through an inlet chamber 44 and flows through the compressor wheel 22 to the diffuser assembly 42. From the diffuser assembly the compressed air is passed by means of an outlet collector box 45 to a recuperator and then to a combustor (not illustrated) of the gas turbine engine.

Figure 2:
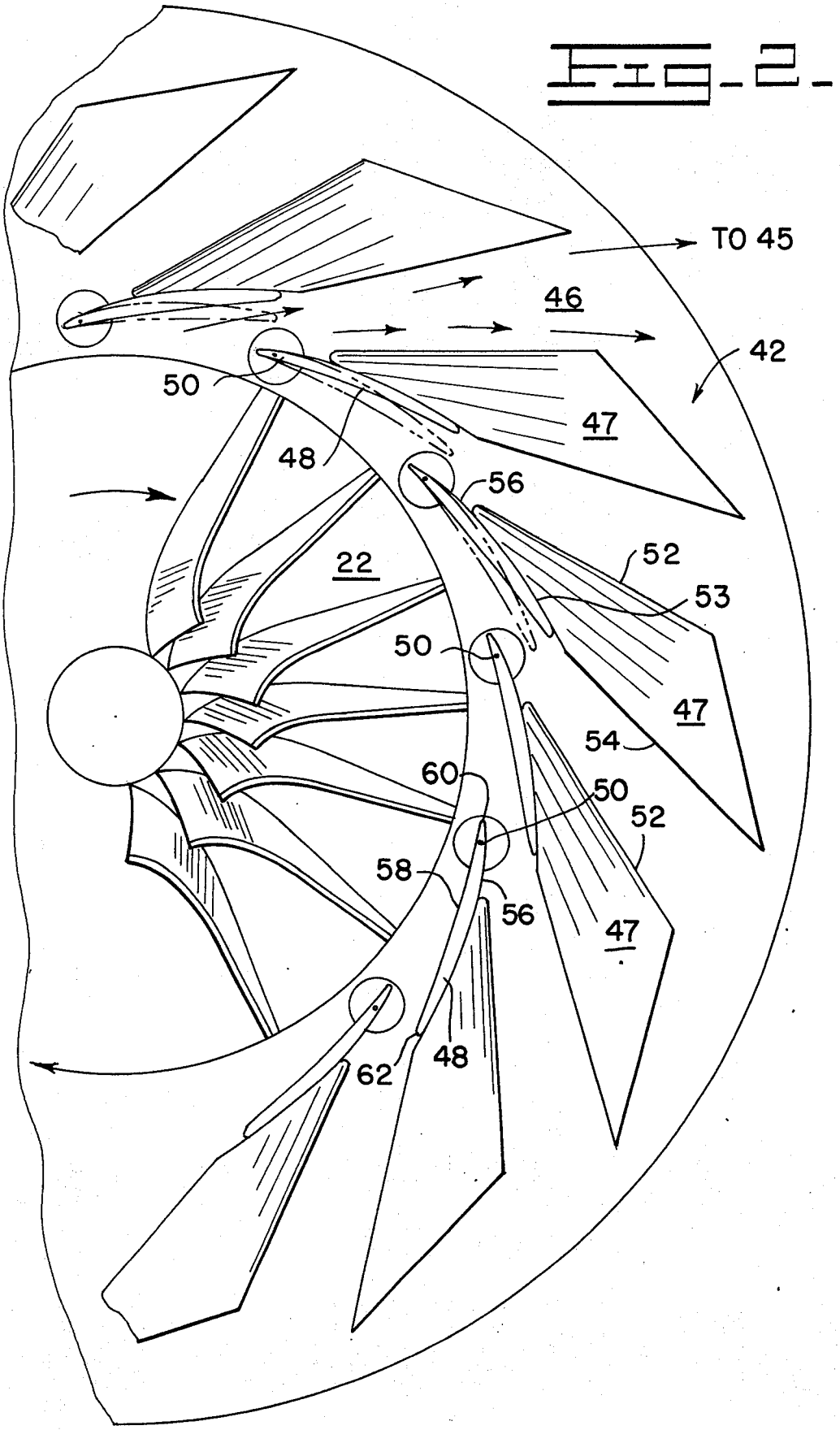
FIG. 2 is a front section of the centrifugal compressor as taken along lines II—II of FIG. 1.
Figure 2A:
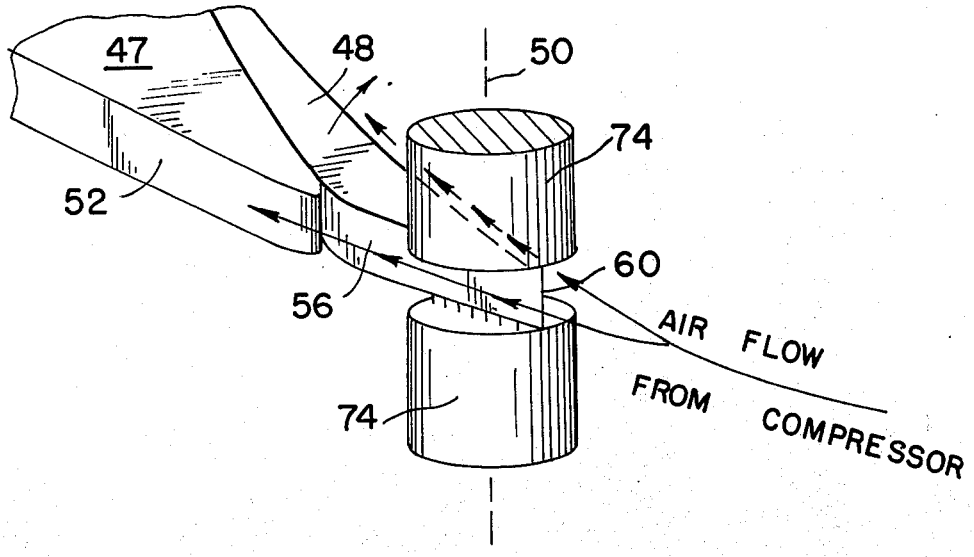
FIG. 2A is a perspective view of one floating-vane and fixed-vane combination shown in FIG. 2.

FIG. 2 shows an open view of the diffuser assembly 42 wherein the stream of air leaving the compressor wheel 22 passes through any number of channels 46, formed by openings between primary fixed diffuser vanes 47, before entering the collector box 45. In accordance with the present invention, the diffuser consists of an annular row of self-aligning vane means which in the FIGS. 1–4 embodiment consists of the primary fixed vanes 47 and associated movable vanes 48, see also FIG. 2A, having a pivot axis 50. The fixed or primary vane 47 is in the form of a vane-island or wedge diffuser having a straight outer side 52 and an inner side consisting of a concave section 53 contiguous with a straight section 54, which together form the suction side of the vane. The terms "outer" and "inner" are referenced with respect to the impeller center line.

Each self-aligning movable vane 48 is generally of airfoil shape, and has a convex outer side 56 with a shape which corresponds to and can smoothly engage or abut the concave inner side 53 of the primary vane 47. The inner side 58 of the movable vane 48 has a generally concave slope which meets the convex outer side 56 to form a leading edge 60 and a lagging or trailing edge 62. The floating vanes 48 are circumferentially spaced along the outer edge of the compressor wheel 22 and form an annular row which is immediately upstream of the annular row of primary or fixed diffuser vanes 47. The outer side 56 of the movable vanes are held against the concave side 53 of the fixed diffuser vanes 47 by a spring bias means which, in accordance with one embodiment, is a coiled torsion spring 70 having one end 72 captured in a bore in the wall of housing 42. The spring's opposite end is fixed to a support pin 74 which is integral with the movable vane 48 and corresponds to the pivot axis 50. The pivot axis is located at the movable vane's leading edge, well ahead of the vane's center of pressure (which is near the vane's center of gravity). Support pins 74 extend outward from the top and bottom of the vane 48 and through mounting means such as bearings formed by bores in the spaced walls of the diffusion section.

Figure 3:
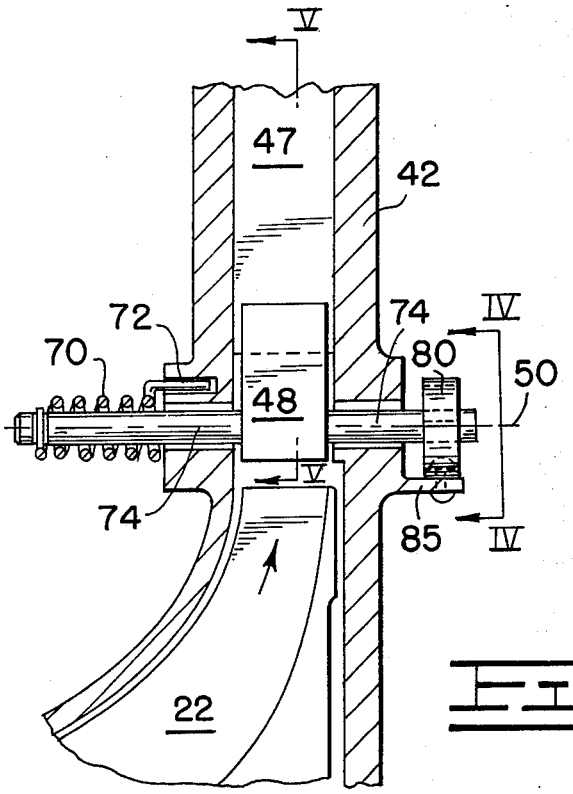
FIG. 3 is a side sectional view taken through one floating vane shown in FIG. 2 and showing two alternate means of torsional restraint.
Figure 4:
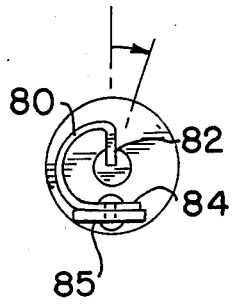
FIG. 4 is an end view taken along lines IV—IV of FIG. 3 and showing in detail the spiral leaf spring means of torsional restraint.

An optional biasing means is also known, associated with the right support pin in FIG. 3 and in FIG. 4, in which a spiral spring 80 has one end 82 located in a slot in the support pin 74 and its opposite end 84 clamped to an extension 85 of the housing 42. It should be understood that only one of the spring biasing means would generally be necessary for a practical embodiment. Either spring biasing method is used to provide the required torque to prevent flutter in the vane, with the torque being applied in a direction to tend to position the floating vane 48 against the primary vane 47.

Under certain operating conditions, a surging problem occurs when the air flow at the diffuser inlet changes velocity and becomes more tangential, as may be understood with reference to FIG. 13 and its related drawings. The steadily deteriorating condition which produces surge is shown in FIGS. 13A, 13B and 13C in which the absolute velocity $V_A$ changes direction because its radial velocity component $V_R$ decreases in magnitude as mass flow decreases. Consequently, the angle $\alpha$ between the absolute velocity $V_A$ and U (impeller tip speed, normal to an impeller centerline) will also decrease. Surging may be described as temporary intermittent reversal of air flow resulting from transient pressure imbalance between the compressor stage suction and discharge. Surging causes vibration and noise, and if the compressor stage is permitted to operate in a surge condition, may result in serious damage.

Surging is prevented at a particular impeller speed by using the movable vanes 48 just described, as may be understood with reference to FIGS. 13D, 13E and 13F, which illustrated similar absolute velocity conditions to FIGS. 13A, 13B and 13C, respectively. For normal steady flow, FIG. 13D, the floating vane 48 is located in its closed position, against the fixed vane 47, and effectively forms a single wedge diffuser. As the tangential velocity flow component increases and the radial velocity flow component decreases, a condition is reached, FIG. 13E, in which the pressure of the fluid stream against the vane 48 moves the vane so that its leading edge 60 continues to have a near-zero incident angle with the flow direction. The principle is similar to that of a weather vane in that by locating the pivoting axis well ahead of the vane center of pressure, the vane will tend to align itself with the flow direction.

As the movable vane 48 moves away from the fixed vane, there is created an auxiliary channel 66 which prevents the formation of turbulent swirls on the inner suction side of the vane 47. This eliminates the surge condition which otherwise would be created, see FIG. 13B, for an equivalent fixed vane having the same tangential flow component. As the tangential component further increases, the movable vane will continue to open until reaching a possible surge condition, FIG. 13F, which corresponds to a region of impossible operation for the fixed vane, FIG. 13C. Beyond this point, an unstable surge condition will occur and a region of impossible operation will be reached.

The cross-section of the movable vane 48 in combination with the cross-section of the fixed vane 47 can be selected by empirical methods so as to produce the most stable operation. The open channel 66 is critical and should provide a smooth flow without creating an excessive amount of flutter in the movable vane 48. The purpose of the spring biasing is to absorb the flutter which will be created when the auxiliary channel is opened.

ALTERNATE EMBODIMENTS OF MOVING VANE - FIXED VANE DIFFUSERS

In FIGS. 5–8, alternate or modified embodiments are shown for the movable vane-fixed vane diffuser. Components serving a purpose similar to the purpose of the components in the previously described embodiment of FIGS. 1–4 have been designated with the same reference numerals, and sometimes may be primed.

Figure 5:
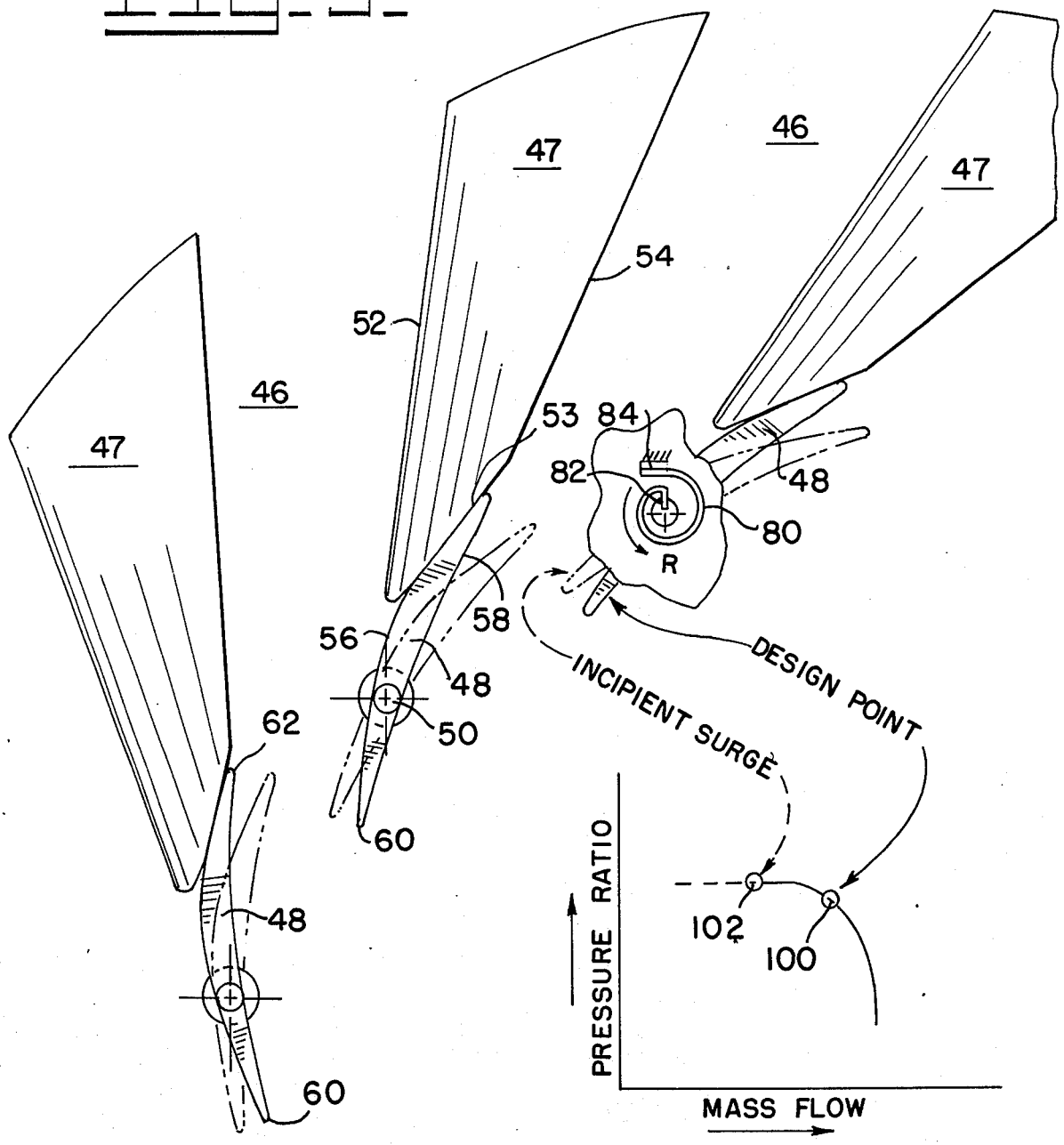
FIG. 5 is a front section similar to FIG. 2 of another embodiment of a vane-island diffuser assembly.

Turning to FIG. 5, a vane-island diffuser is illustrated which is generally similar to the previous embodiment, except that the pivot point 50 has been moved back further from the leading edge 60 to a position closer to the center of the vane. The pivot axis 50 is still forward of the center of pressure and center of gravity of the vane 48, so that the incident flow will move the vane into alignment with the direction of the incidence flow stream. When the diffuser is operating at its design point 100, as illustrated on an accompanying chart of compressor mass flow vs. pressure ratio, the movable vane 48 is in its closed position, as illustrated by the solid lines, and lies against the primary vane 47. As the mass flow decreases and the tangential velocity component increases, the vane 48 will rotate clockwise and open an auxiliary channel, for the purposes previously described. Upon rotating to an incipient surge point 102, the vane will have the position illustrated by the dashed lines, which represents the maximum opening of the auxiliary channel before an instable region is reached.

Figure 6:
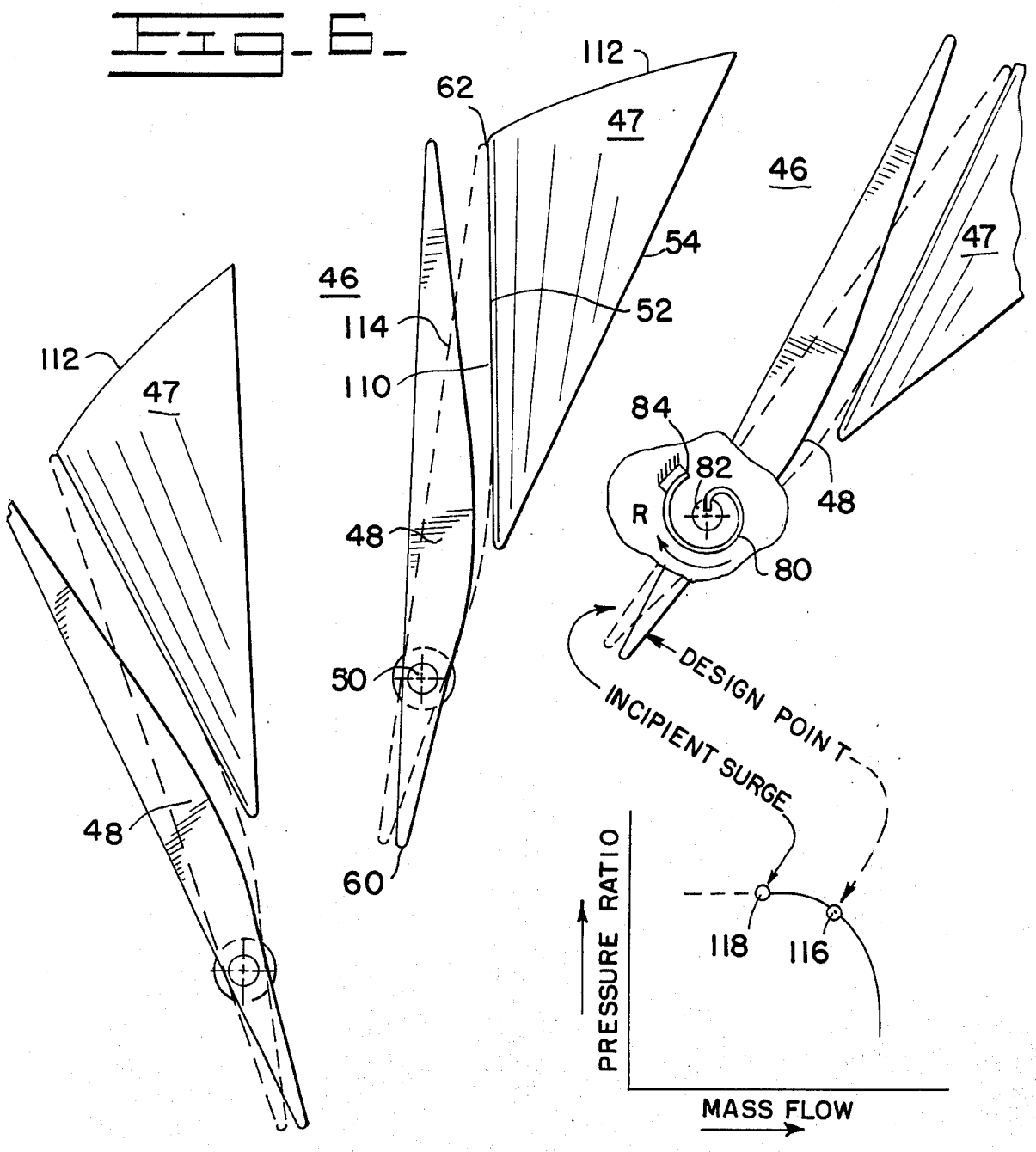
FIG. 6 is a front section similar to FIG. 5 of another embodiment of a vane-island diffuser with the floating vanes located in an alternate position.

It is not essential that the secondary movable vane 48 be in engagement with the primary vane 47 at the design point of the compressor stage. The vane can be spaced its maximum distance from the primary vane, and close the channel as surge is approached. As illustrated in FIG. 6, the movable vane 48 is located to engage the outside edge 52 of the primary vane 47. The inner side 110 of the vane 48 is generally convex and has a straight section adjacent the straight line side 52 of the wedge 47. The trailing edge 62 of the vane 48 is extended so as to terminate in the vicinity of the outer radial end 112 of the wedge vane 47. The outer side 114 of the movable vane 48 is straight and extends between the trailing edge 62 and the leading edge 60.

The pivot point 50 of the movable vane 48 of FIG. 6 is generally in the same region as the pivot point 50 in FIG. 5. However, the size of the movable vane 48 has been increased substantially, and during normal operation is maintained in an open position, as illustrated by the solid lines. That is, when operating at its design point 116, the movable vane 48 is spaced its maximum distance away from the primary vane 47. As mass flow decreases, the movable vane 48 moves clockwise to close the auxiliary channel. Upon reaching an incipient surge point 118 and as illustrated by the dashed lines, each of the vanes 48 abuts against its associated fixed vane 47 and effectively forms therewith a single row of fixed diffuser vanes.

Figure 7:
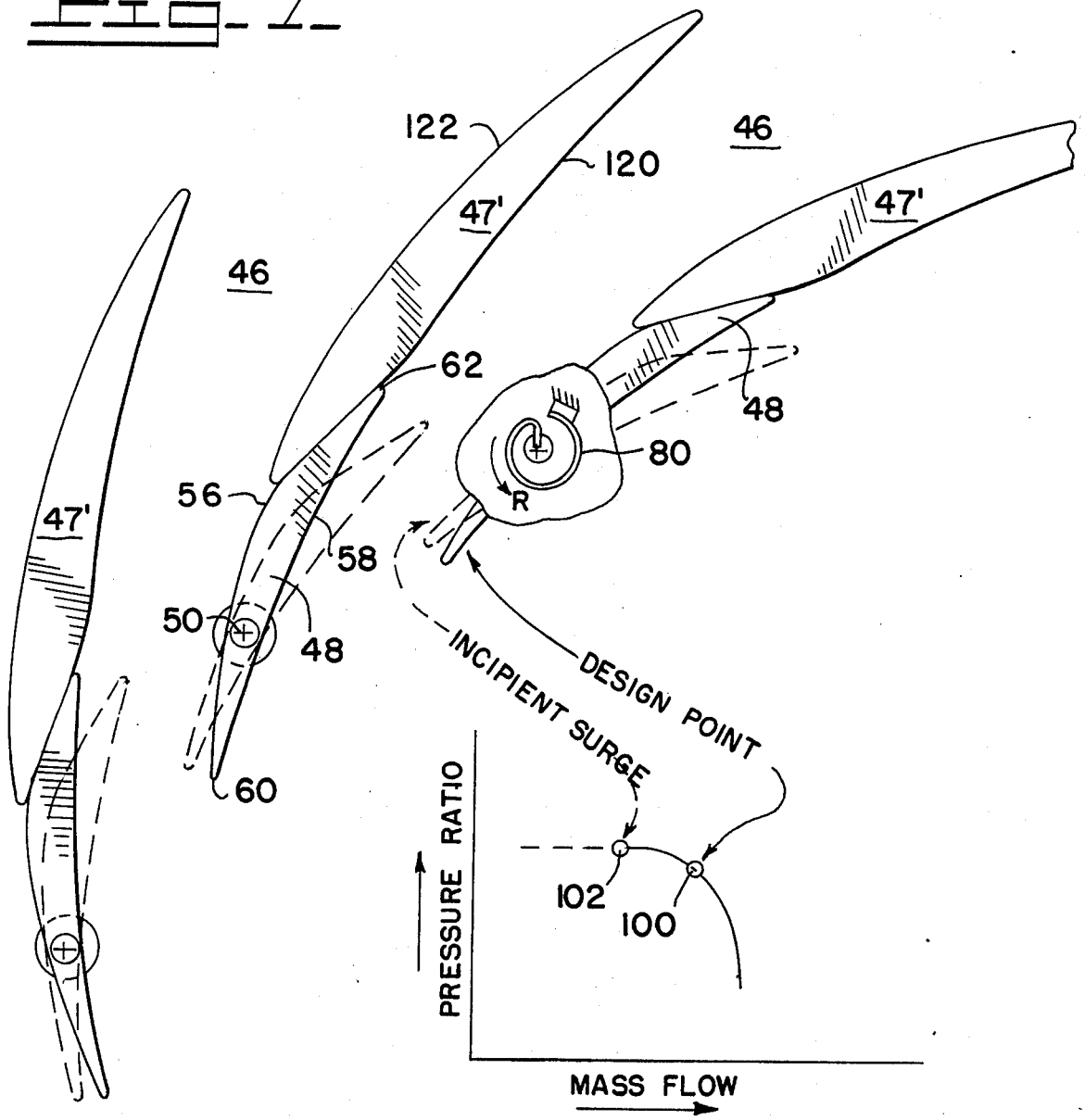
FIG. 7 is a front section similar to FIG. 5 of another embodiment using an airfoil-vaned diffuser assembly.

The invention is applicable to either a vane-island diffuser or an airfoil-vane diffuser. Turning to FIG. 7, an alternate embodiment is illustrated which is generally similar to FIG. 5, except that the primary fixed vane 47′ is in the form of an airfoil-vane having a concave suction side 120 and a convex pressure side 122. Because of the diffusing nature of the vane cascade, the pressure side and suction side of the airfoil are opposite to the pressure side and suction side of a lifting airfoil device, as is well known. The operation of the movable vane 48 is basically the same as FIG. 5, and the design point and incipient surge point also generally correspond.

Figure 8:
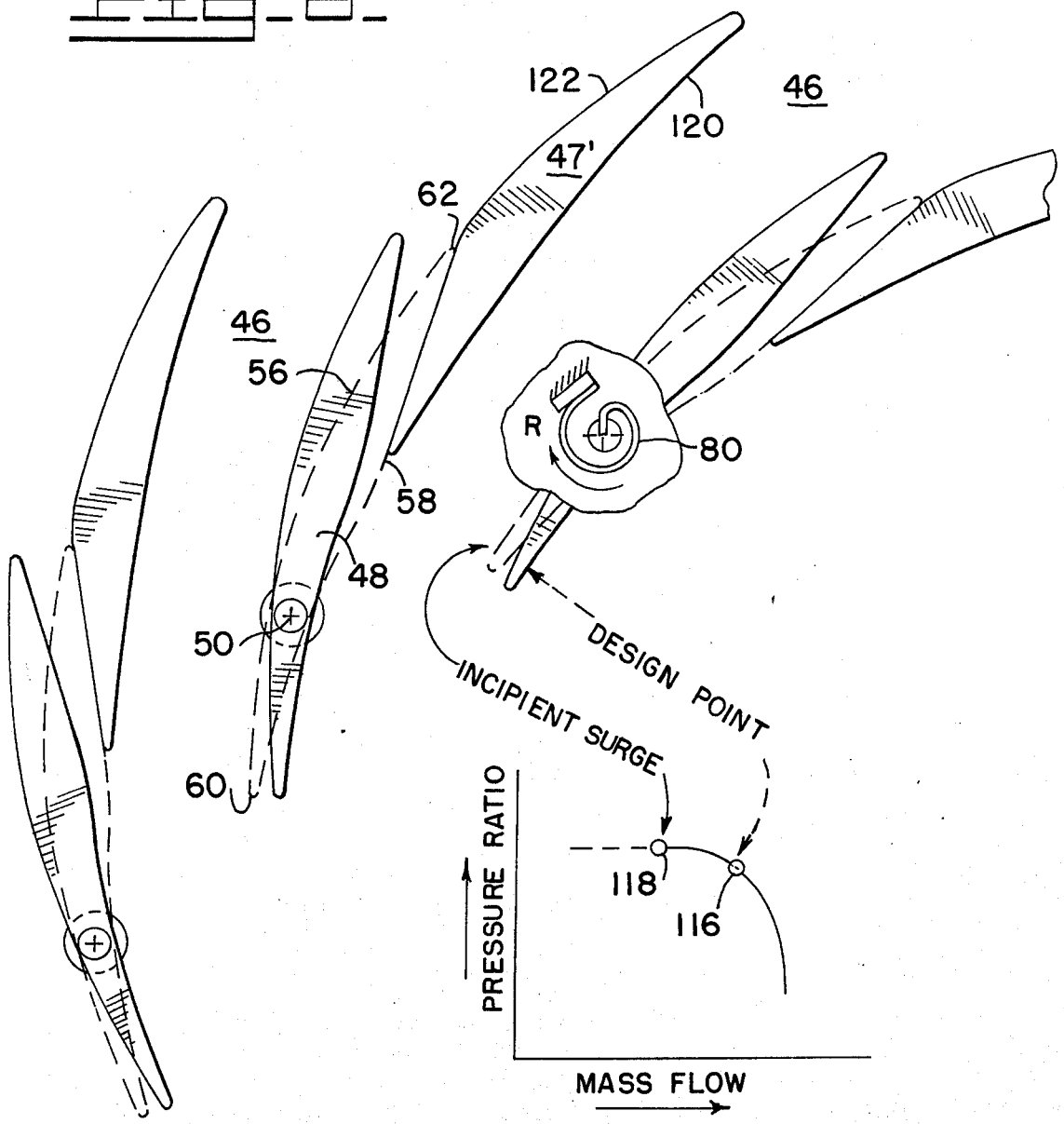
FIG. 8 is a front section similar to FIG. 7 of another embodiment with the floating vanes located in an alternate position.

Turning to FIG. 8, a movable vane diffuser is illustrated which is similar to the vane-island diffuser of FIG. 6 but using an airfoil-vane design. Another modification is that the trailing edge 62 does not extend as far as with the vane-island diffuser, and terminates generally upstream of the center point of the fixed vane 47′. The design point and incipient surge points are relatively the same as FIG. 6. As previously noted, the cross-sectional shapes of the floating vane 48 and the fixed vanes 47 or 47′ are best selected empirically in order to create a minimum of flutter when the movable vane 48 is in its open position.

Figure 11:
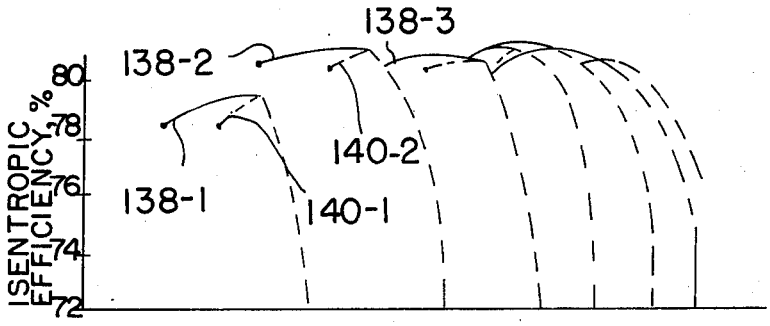
FIG. 11 is a chart of the potential efficiency improvement curves produced by the floating vane configuration also illustrated in FIG. 12.
Figure 12:
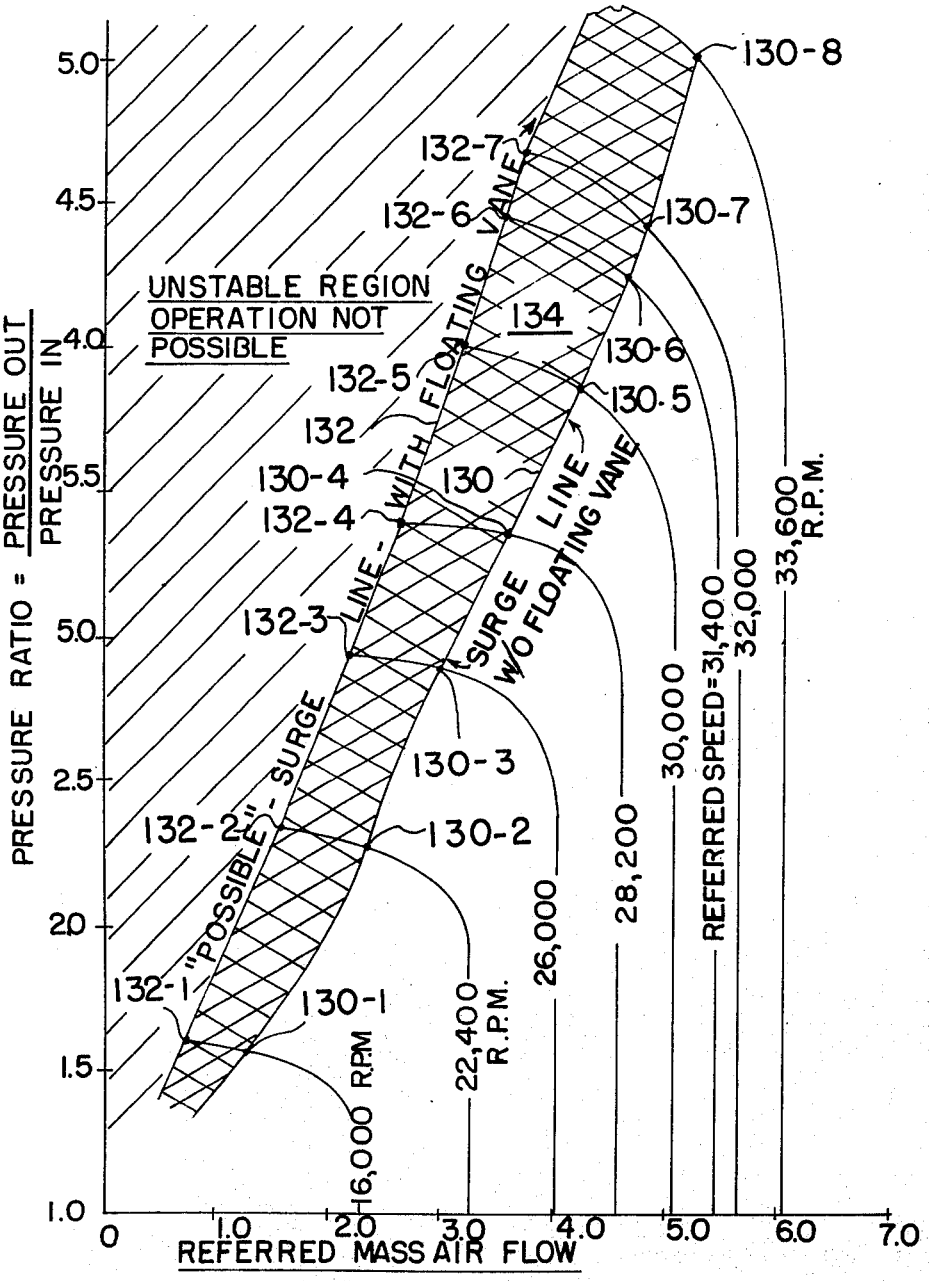
FIG. 12 is a performance map of a typical industrial-type centrifugal compressor for various speeds of the compressor wheel and shown without a floating vane, and with a floating vane configuration of the type shown in FIG. 5.

FIGS. 11 and 12 illustrated the improvement in performance which can be obtained by use of the present invention. These figures illustrate a typical centrifugal compressor performance map for the embodiment shown in FIG. 5. It should be understood that the exact shapes of the movable and fixed vanes, as well as the surrounding environment, will affect performance and alter the performance map. FIG. 12 is thus a representative illustration of the operating characteristics of the compressor stage with respect to pressure ratio, air mass flow, and impeller speed. Eight constant speed line curves are illustrated, each having a surge point 130-1 to 130-8 which in the limit defines a surge line 130 for the FIG. 5 embodiment without the floating vane feature. That is, the floating vane 48 would be fixed against the primary vane 47 to in effect form a single row vane-island diffuser. To the right of the surge line 130 is a safe operating region, whereas to the left, a compressor surge will exist.

When the vane 48 is now allowed to float or move due to changes in tangential velocity, new surge points 132-1 through 132-8 will exist at a lesser referred mass air flow on the constant speed line curves, defining a new potential or possible surge line 132, the exact location of which will vary with the particular shape of the vanes and the surrounding environment. The cross-hatched area 134 between the surge lines 130 and 132 represents the increased zone of operation made possible by the self-aligning vane configuration. The area shown to the left of the surge line 132 still represents an unstable region in which operation would be impractical.

The solid line curves 138-1, 138-2, etc., charted on FIG. 11 correspond to the points 132-1, 132-2, etc., of FIG. 12 and indicate the potential efficiency improvements due to the floating vanes, since efficiency varies with mass flow at a given impeller speed. The dashed lines 140-1, 140-2, etc., correspond to the surge points 130-1, 130-2, etc., of FIG. 12 and represent the efficiency prior to the addition of the floating vanes.

The effect of negating the stall or surge inducing incidence flow is to reduce the surge mass flow of the compressor stage without penalizing stage efficiency at higher mass flow operating points. Also, use of the self-aligning diffuser vanes results in the compressor stage peak efficiency being obtainable over a wider mass flow operating range, at constant impeller speed. The theory of design is compatible with criteria currently used in the aero-dynamic design of state-of-the-art diffusers for centrifugal compressors of many types including those used in turbine engines, turbochargers, natural gas compressors, refrigeration systems, and the like.

ALTERNATE EMBODIMENTS USING SELFALIGNING PRIMARY SELF-ALIGNING

Figure 9:
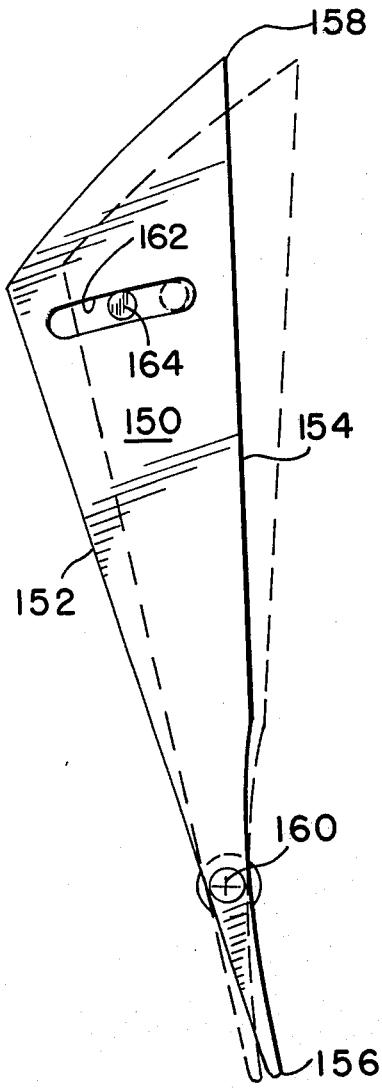
FIG. 9 is a front section of another embodiment in which primary vane-island diffuser vanes are permitted to float about pivot axes.

For some compressors, design can be simplified by combining into one row the row of movable vanes and the row of fixed primary vanes. In FIG. 9, a primary vane-island diffuser vane 150 has an outer side 152 and an inner side 154 which diverge from a leading edge 156 to form a wedge body having a trailing edge 158. A pivot point 160 is formed upstream or forward of the center of pressure of the vane, and comprises outwardly extending support pins which are journalled through the walls of the diffusion section, and which are damped by spring biasing means, as previously described. The amount of annular rotation is restrained, and the vane is supported by an elongated angular slot 162 formed in the rear body of the wedge 150, behind the center of pressure. The center of the radius of the curved slot 162 is at the pivot point. A pin 164 extends from the diffuser wall assembly into and is captured by the slot. The entire primary vane 150 will thus rotate about the pivot point 160 and will tend to maintain the leading edge 154 at a near-zero incidence angle to the fluid flow stream.

Figure 10:
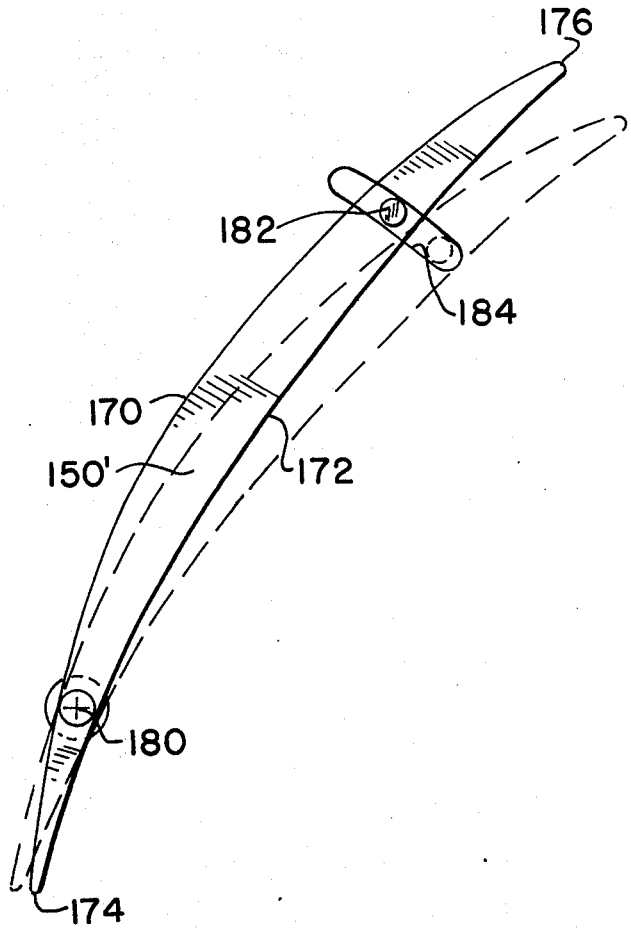
FIG. 10 is a front section similar to FIG. 9 of another embodiment in which primary airfoil diffuser vanes are permitted to float about pivot axes.

The principle is applicable to airfoil diffusers, as shown in FIG. 10. The airfoil vane 150' has a convex pressure side 170 and a concave suction side 172 which join in a leading edge 174 and a trailing edge 176. A pivot point 180 is located forward of the center of pressure, in generally the same location as the pivot point 160, and comprises outwardly extending guide pins and associated spring bias means (not illustrated) as previously described. To limit and support angular rotation, a guide pin or roller 182 is integral with or attached to the rear body of the vane 150', near the trailing section and behind the center of pressure, and extends into an elongated curved slot 184 in the diffuser wall assembly 32. The center of the curve of the slot corresponds to the pivot point. Thus, the vane 150' will freely rotate or float (subject to the spring bias provided to eliminate flutter) with respect to the pivot point so as to align with the absolute flow direction.

While the self-aligning vanes have been illustrated as used in a diffuser for a centrifugal compressor, it will be appreciated that the above-described techniques are applicable to other components of a gas turbine engine and to other turbomachines. For example, the technique is applicable to the second stage nozzle of a two-stage turbine, in which the direction of incidient fluid flow will vary at the nozzle inlet. Other changes and modifications will be apparent in view of the above teachings.

I claim:

1. In a turbomachine having a channel defined by spaced wall means and an impeller rotatable for inducing in the channel a fluid flow which can change direction, the improvement comprising: a plurality of fixed vanes mounted between the spaced wall means; a plurality of movable vanes each associated with a different one of the fixed vanes and each having a closed position abutting the associated fixed vane to form effectively therewith a single fluid channeling member; mounting means movably mounting each of the movable vanes between the spaced wall means for causing the fluid flow to space the movable vanes from said closed position; and spring means acting between said wall means and said movable vanes biasing said movable vanes to said closed position.

2. The improvement of claim 1 wherein the plurality of movable vanes each has a generally airfoil shaped body with a pivot located forwardly adjacent the center of pressure of the body, the mounting means pivotally connecting the pivot to the spaced wall means to cause the fluid flow to rotate the airfoil shaped body into alignment with the flow direction, and said spring means being connected to said pivot.

3. The improvement of claim 2 wherein the movable vanes rotate away from the fixed vane against the biasing action of the spring means as a surge condition is approached.

4. The improvement of claim 1 wherein the vanes are disposed adjacent the impeller to form a diffuser for converting the kinetic energy of the fluid flow leaving the impeller into a static pressure.

5. The improvement of claim 4 wherein each of the plurality of fixed vanes has an arcuate portion adjacent the associated movable vane, and each of the movable vanes has an arcuate portion having smooth mating engagement with said arcuate portion of the associated fixed vane when the movable vane is moved into engagement therewith.

* * * * *